United States Patent [19]

Woodrow

[11] Patent Number: 4,653,226

[45] Date of Patent: Mar. 31, 1987

[54] WINDOW SECURITY UNIT

[76] Inventor: Ernest L. Woodrow, 1330 Forest St., Topeka, Kans. 66616

[21] Appl. No.: 790,895

[22] Filed: Oct. 24, 1985

[51] Int. Cl.[4] ..... E06B 3/68

[52] U.S. Cl. ..... 49/57; 49/50

[58] Field of Search ..... 49/57, 55, 50; 160/225

[56] References Cited

U.S. PATENT DOCUMENTS

| | | | |
|---|---|---|---|
| 953,197 | 3/1910 | Fox | 49/57 |
| 2,722,722 | 11/1955 | Mussman | 49/57 |
| 4,059,923 | 11/1977 | Sauer | 49/57 |
| 4,283,881 | 8/1981 | Moore et al. | 49/57 |
| 4,478,002 | 10/1984 | English | 49/57 |

*Primary Examiner*—Kenneth J. Dorner
*Assistant Examiner*—Gerald A. Anderson
*Attorney, Agent, or Firm*—Thomas M. Scofield

[57] ABSTRACT

Improvements in guard devices for windows; a bar carrying frame removably fixable within the runs for the upper sash of a double hung sash window; improvements in guard and protective devices for double hung sash windows wherein the lower sash may be fully opened while the upper sash may be partially opened; window guard improvements where the barred frame member inserted in the window is instantly removable from the inside of the dwelling in case of an emergency such as a fire to enable egress out the window if necessary.

12 Claims, 8 Drawing Figures

Fig. 1.
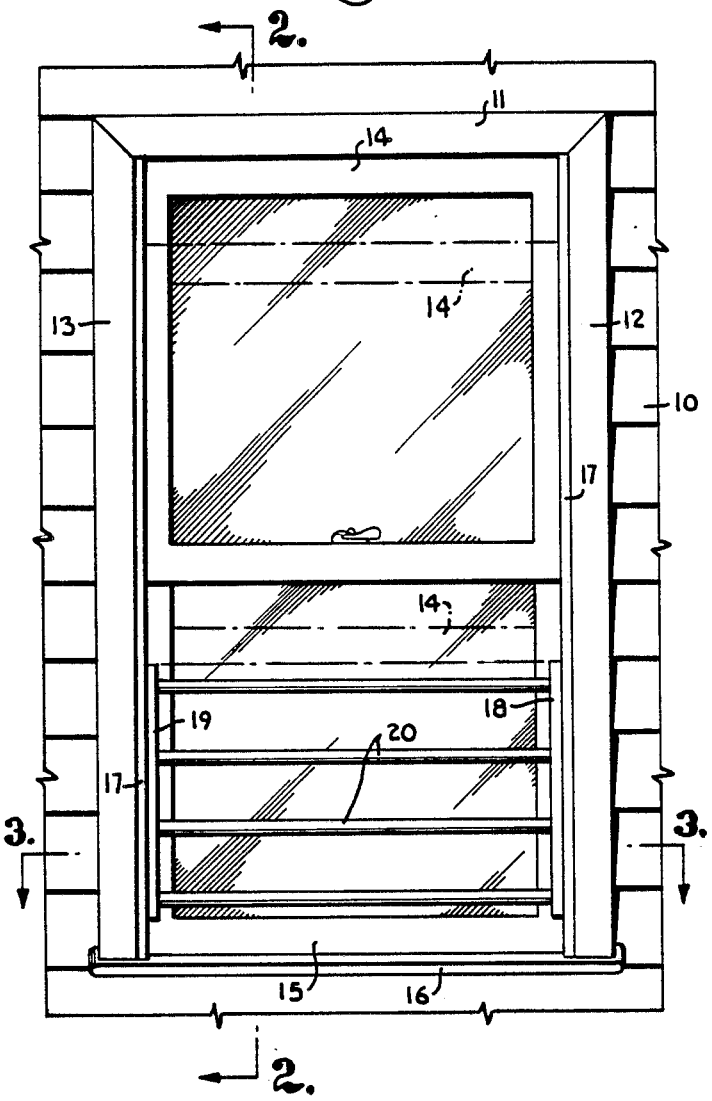
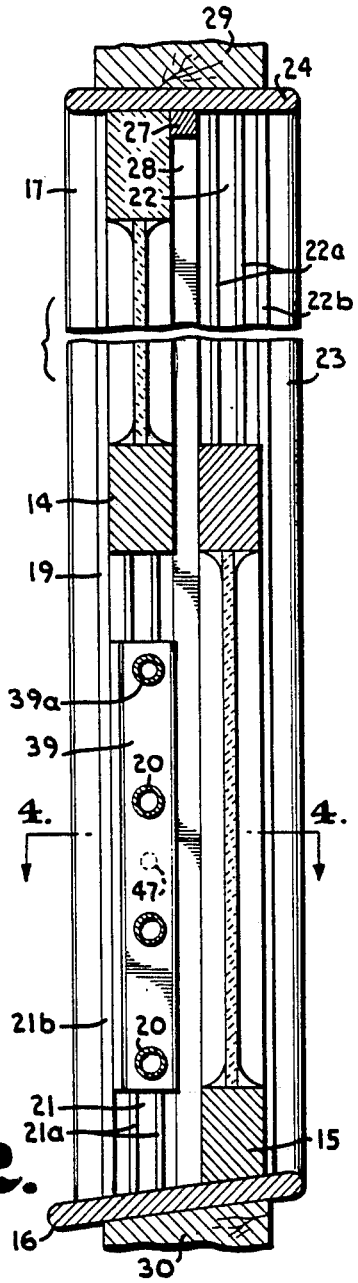
Fig. 2.
Fig. 3.
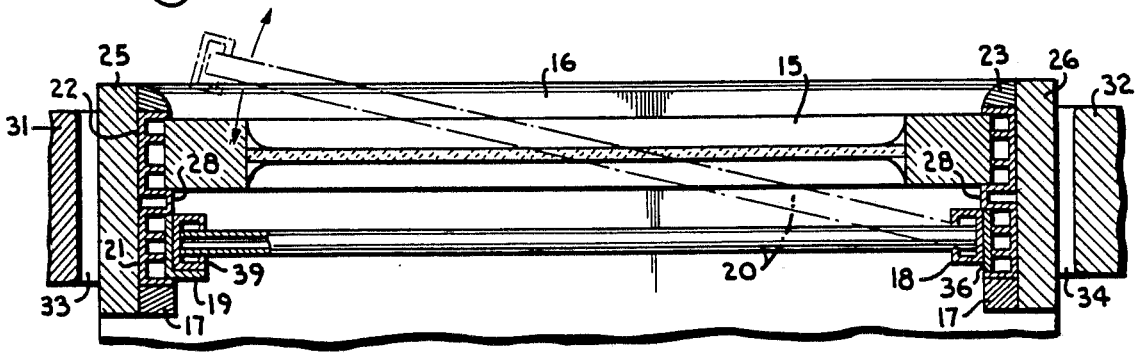

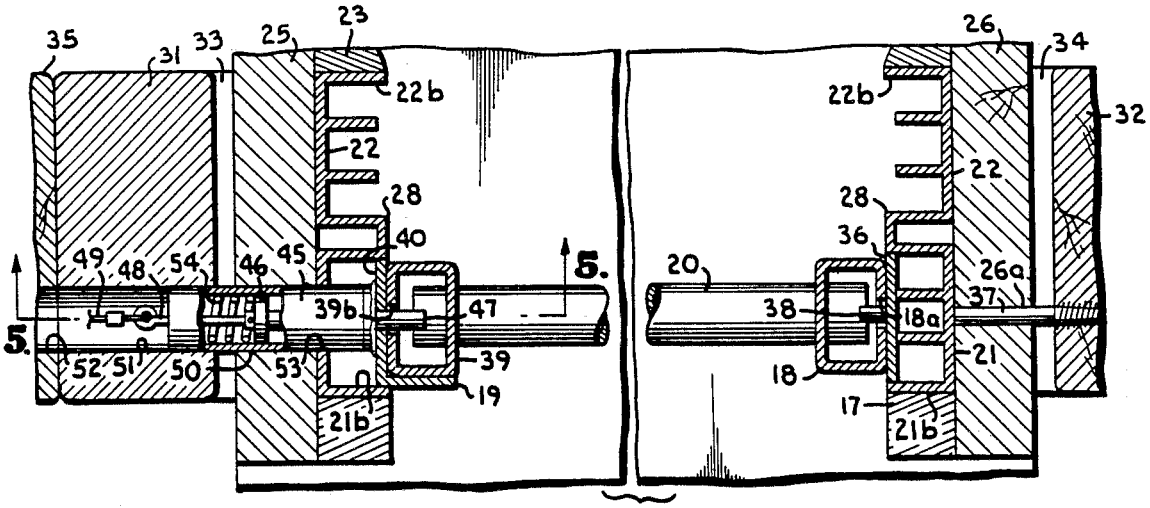
Fig.4.
Fig.5.
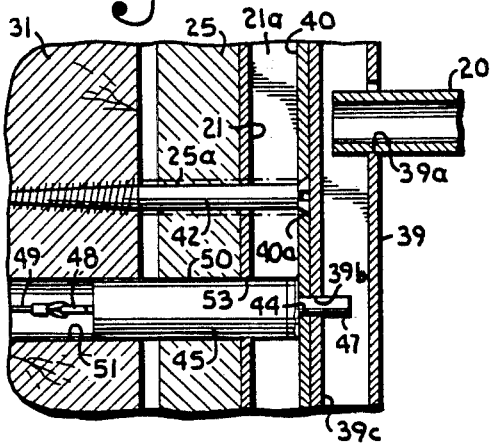
Fig.6.
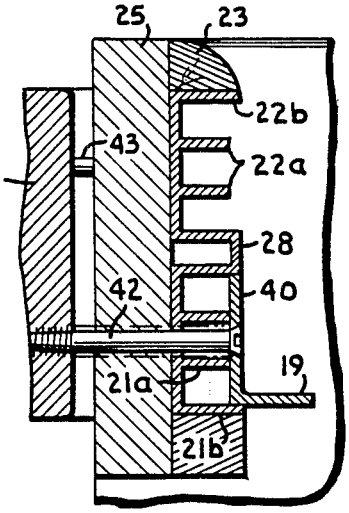
Fig.7.
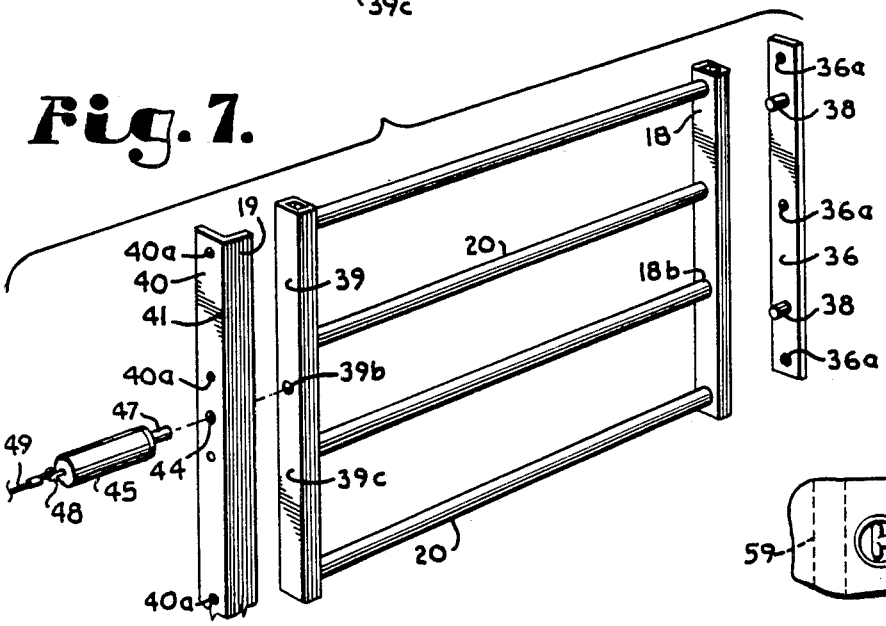
Fig.8.
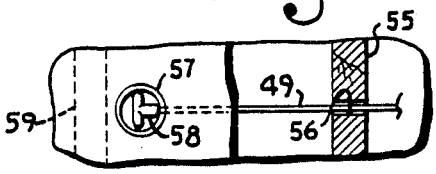

WINDOW SECURITY UNIT

BACKGROUND OF THE INVENTION

In recent years, the problems of breaking and entering into houses and apartments has become more and more serious. Not only is the incidence of burglary increasing in rural as well as urban areas, the most violent crimes often accompany a breaking and entering. The degree of threat, therefore, has risen markedly over recent years to homeowners and apartment dwellers alike, not least because of problems with drugs.

Previously, many efforts have been made to effectively secure window areas against access to criminals and intruders. Fixed bars and grills in some cases are effective to protect against break ins. Such, however, are often expensive, hard to effectively install and they operate to prevent any egress out the window from inside the apartment or house in fires or other emergencies.

Other devices have been provided associated with the window frame or sash runs of the window frame. These devices typically block the entire window area, may interfere with the proper operation of the window, are not readily removable from the inside of the house in case of fire or the like or often are not sufficiently solidly and effectively mounted with respect to the window area to be protected.

THE PRIOR ART

Applicant is aware of the following patents directed to protective grills, guards and inserts for doors and windows.

Matthiesen et al U.S. Pat. No. 1,799,308, issued Apr. 7, 1931 for "Self Adjusting Screen Door Grill . . . ".

Crandall U.S. Pat. No. 1,954,559 "Window Guard", issued Apr. 10, 1934;

Zukor U.S. Pat. No. 2,195,291 "Protector For Windows", issued Mar. 26, 1940;

Becker et al U.S. Pat. No. 2,303,718 "Window Guard", issued Dec. 1, 1942;

Beil U.S. Pat. No. 3,386,219 "Window Grill", issued June 4, 1968;

Kordewick U.S. Pat. No. 4,000,590 "Security Grill", issued Jan. 4, 1977; and

Earley U.S. Pat. No. 4,162,590 "Burglar Bar Apparatus" issued July 31, 1979.

BRIEF DESCRIPTION OF THE INVENTION

The subject improvement is a guard unit for a window frame construction utilizing a double hung sash. Such a window frame construction typically has a top header, a bottom sill, vertical side jambs, vertical sash runs mounted inwardly of the window space with respect to said jambs, an upper sash mounted on the outer one of said sash runs outwardly of the window frame and a lower sash mounted on the inner sash run inwardly of said frame.

A pair of opposed elongate, vertical plates are mounted in opposition to one another in the outer sash runs for the upper sash. These plates, running parallel and in opposition to one another, are rigidly connected through the window frame construction into the outer wall structurals framing the vertical side jambs. One of said plates is simply an elongate flat member. The other plate is a L shaped angle iron.

A guard frame is provided including a plurality of central, vertically spaced apart, normally horizontal bars connecting at the ends thereof with a pair of outer, normally vertical post members. The post members are each mountable with respect to one of said plates. Specifically, a first one of said post members is removably but fixedly received on at least a pair of vertically spaced apart, horizontal fingers or projections on the flat plate. The projections engage openings in the said first post between the bars carried thereby.

The opposite plate, as previously noted, is a L-shaped member in transverse section. One flange of the L faces into the sash run, the other extends inwardly of the window frame at right angles to the sash run and jamb of that side.

The second, opposite post is removably engageable by said L shaped second plate with there being a spring loaded plunger mounted through the base of said plate to engage an opening in said second post. The cylinder carrying the spring which spring loads the plunger is mounted through the sash run, jamb and into the structurals framing the window on that side thereof.

OBJECTS OF THE INVENTION

A first object of the invention is to provide an improved window guard device involving a bar carrying frame which is removably mountable within the sash runs for the upper window sash of a conventional window construction.

Another object of the invention is to provide an all steel, window barring unit which is constructed from available stock materials and can be readily made in a variety of sizes.

Another object of the invention is to provide a new, effective window barring unit which is mounted in the sash runs of the upper window sash yet permits or enables the upper window sash to be lowered approximately six inches for ventilation and other purposes.

Yet another object of the invention is to provide such an improved window guard unit wherein, when the unit is properly installed, there are no screws or bolts visible to be tampered with, as well as hinges to rust or to be pried apart.

Another object of the invention is to provide a release mechanism permitting the removal of the frame and bars from the window which has no keys or other mechanism to result in failure.

Still another object is to provide such a barred window guard unit wherein the bars, as received in their mountings, roll freely to prevent hacksawing.

Yet another object of the invention is to provide such a window guard involving a barred frame mounted within the upper window sash run wherein the base members of the unit are secured through the window structure to the conventional existing structural wall frame work around the window (the two by four legs and studs on either side of an existing window) and wherein the operative handle for the instant release mechanism is located at least three feet from one side of the open window to secure such against access by a would be intruder.

Other and further objects of the invention will appear in the course of the following description thereof.

THE DRAWING

In the drawings, which form a part of the instant specification and are to be read in conjunction therewith, embodiments of the invention are shown and, in the various views, like numerals are employed to indicate like parts.

FIG. 1 is a front perspective view, from the outside of a house, of a window frame installed in the wall of the house with the subject improvement applied thereto or mounted therein.

FIG. 2 is a view taken along line 2—2 of FIG. 1 in the direction of the arrows.

FIG. 3 is a view taken along the line 3—3 of FIG. 1 in the direction of the arrows.

FIG. 4 is a view taken along the line 4—4 of FIG. 2 in the direction of the arrows.

FIG. 5 is a view taken along the line 5—5 of FIG. 4 in the direction of the arrows.

FIG. 6 is a view like that of the left hand side of FIG. 4, but adjacent the bottom of the sash run, with the frame post removed and showing one of the bolts pinning the left hand (of the views of FIGS. 1, 3, 4 and 7) plate member to the structural framework of the window frame and wall.

FIG. 7 is a three-quarter perspective view, exploded, from the front, showing the elements of the guard frame positioned individually with respect to one another.

FIG. 8 is a fragmentary elevation taken to the left of FIGS. 4 and 5 (in a different scale) showing the cable for releasing the device going to the release handle.

STRUCTURE AND FUNCTION

Referring first to FIG. 1, at 10 is shown the siding of a house around a window frame construction of conventional type. In the view of FIG. 1 there may be seen the outer casing 11, 12 and 13 of the window, as well as the upper (outer) sash 14, inner sash 15 and sill 16. Stops 17 for the sash runs to be described are adjacent the vertical post element 18 and front face 19 of angle iron 41, both to be described. Post 18 and post 39 to be described (FIG. 7) mount a plurality of preferably round bars 20 therebetween.

Referring to FIGS. 2 and 3, in addition to the parts named with respect to FIG. 1, there is seen the forward or outer sash run 21 for the upper sash 14 having two somewhat recessed inner members 21*a* and outboard flange 21*b*. There is also inboard or inside sash run 22 with somewhat recessed members 22*a* and inboard flange 22*b*. Stops 23 abut flanges 22*b* in the opposed lower sash run inboard of sill 16.

Header 24 of the jamb overlies side jambs 25 and 26 which are side vertical members of the window frame construction and is connected thereto. Centrally of the underside of header 24 is horizontal spacer member 27 (FIG. 2) which communicates between the upper ends of the two dividing members 28 of the sash runs 21 and 22. Sash runs 21 and 22, which typically are an integral structure interconnected by dividing member 28, are fixed through the inboard surfaces of jambs 25 and 26 into the outer wall structurals to be described.

Jamb header 24 has connected to the top thereof structural support header 29 in the base framing of the building construction. The latter connects overhead to the upper plate of the wall in conventional manner. Likewise, sill 16 has horizontal two by four member 30 underlying the same with vertical members (not seen) connecting member 30 to the lower plate (not seen) of the wall. To the left and right in FIG. 3 at 31 and 32 next to jamb members 25 and 26, respectively, there are seen the center legs of broken or interrupted two-by-fours which, most typically, lie next to jamb structurals 25 and 26 on each side of the window. Spaces 33 and 34 may be present between jamb 25 and leg 31 and jamb 26 and leg 32, respectively. Referring to FIG. 4, at the left hand side, this being a sectional view looking down as is the case in FIG. 3, in the very left hand of the view there may be seen the second two-by-four which is conventionally provided in the wall framing around a window frame construction. Specifically, because of the loss of structural strength due to the insertion of the window frame in the wall construction, two studs are typically provided on each side of a window frame as seen at 31 and 35. A like paired stud construction would be provided next to jamb 26, center leg 32 seen at the right in FIGS. 3 and 4 being the first one of those two structurals or studs on that side.

Referring first to FIG. 7, and also the right hand side thereof, a first elongate plate member 36 is provided for mounting in the lower portion of sash run 21 for the top or outside sash 14. This mounting is seen to the right front in both FIGS. 3 and 4, best seen in FIG. 4. Plate 36 is of a width such as to closely fit between flange 21*b* of sash run 21 and one wall of divider 28 of the sash runs 21 and 22. Plate 36 has screw openings 36*a* therethrough to receive elongate screws such as screw 37 seen in the lower right center of FIG. 4 therethrough. Screw or screws 37 have countersunk heads in openings 36*a* analogous to the countersunk heads of the screws 42 seen in FIGS. 5 and 6 to be described. Because of the complexity of structure in the view of FIG. 4, the engagement of screw 37 with plate 36 is not seen but such is like that of the countersunk screws of FIGS. 5 and 6 to be described. On the inboard or inner side of plate 36, there are provided rigid, right angle extensions, members or posts 38.

Looking at the center of FIG. 7, therein is seen two side posts or sleeves 18 and 39. Post or sleeve 18 is hollow and rectangular in transverse horizontal section. This is best seen in FIG. 4. A pair of openings 18*a* are provided adjacent the upper and lower ends of post 18, specifically between the two upper and two lower bars 20 adapted to receive members 38. Four openings 18*b* are provided on the inboard side of post 18 to receive bars 20 therewithin in friction fit but rotatable fashion. While FIG. 3 shows a relatively tight fit of the bars 20 within sleeves or posts 18 and 39, such is not intended to be tight enough that bars 20 are not rotatable within the post 18 and 39.

Referring now to the left hand side of FIG. 7 therein is provided angle iron 41 with two flanges 19 and 40. Face or flange 19 of angle iron 41 is that one seen in FIG. 1 and beam or face 40 of angle iron 41 being that flange received between outermost flange 21*b* of sash run 21 for upper sash 14 and the outer face of divider 28 of the sash run. The inner flange 40 of angle iron 41 has a plurality of openings 40*a* therewithin operative to receive a plurality of bolts 42 therethrough as seen in FIGS. 5 and 6.

As may be seen from FIGS. 5 and 6, screws 42 penetrate (through a bored hole therein) not only the window frame jamb 25, but also thread into at least the adjacent wall center leg 31. Alternatively and preferably, screws 42 thread through the center leg 31 and at least substantially into stud 35. Protective sleeves of metal such as stainless steel may be provided on the unthreaded length of screws 42, as is the case with respect to screws 37 which operate to fix plate 36 through the window frame construction to the wall structurals. In FIG. 6 there is also seen one of the screws 43 which fix the sash runs 21, 22 through the window frame construction to the surrounding wall structurals. Several of these screws are provided up and down the length of each side 21, 22 of the sash runs on each side of the window frame construction.

Referring back to FIG. 7, post or sleeve 39 is substantially identical to post or sleeve 18. First, with respect to its size, length and configuration. Next with respect to the presence of openings 39*a* on the inboard face thereof (as at 39*a* in FIG. 5) rotatably receiving bars 20. Post 39 differs from post 18 in having only one opening 39*b* on its outer face operative to receive a holding or locking means therein or therethrough. Opening 39*b* is provided only through the outside or outer wall 39*c* of post 39 as is the case with respect to openings 18*a* in post 18. Like and matching opening 44 is provided through flange 40 of angle iron 41.

An elongate cylindrical body 45 mounts plunger 46 (FIG. 4) therewithin which mounts elongate rod 47 extending out one end of cylinder 45 which is the right hand end in the views of FIGS. 4, 5 and 7. Connecting rod 48 is joined to the opposite side of plunger 46 from rod 47, extends outwardly of cylinder 45 and has cable or wire member 49 connected thereto. Openings or passageways 50, 51 and 52 (FIG. 4) are provided through jamb member 25, center leg 31 and stud 35, respectively, for the insertion and mounting of cylinder 45 therethrough. An opening 53 is further provided through the sash run 21, removing sash run members 21*a* in a portion of their length so that the front end of cylinder 45 may be welded or otherwise fixedly attached to the outer face of flange 40 of angle iron 41.

Wire or cable 49 is led at least through the second stud 35, but most preferably considerably further laterally through at least two additional wall studs (not seen) before an opening is made in the inner house wall and a handle installation is made at the end of cable 49. Such operates the plunger 46 against spring 54 in cylinder 45 to enable or effect the withdrawal of plunger or rod 47 from opening 39*b* in post 39. The effect of such withdrawal is seen in FIG. 3 where, in dotted lines, the frame 18, 20, 39 is shown as pivotable with respect to the mounting pegs or posts 38 on plate 36. Unless the cable 49 handle attachment drawing on cable 49 against spring 54 of plunger 46 is positioned far enough inside the house away from the window that it cannot be reached by someone putting their arm through bars 20, there is the hazard of an intruder releasing the guard frame 18, 39, 20 from its mounting members 36 and 41 and obtaining access to the house. Accordingly, cable 49 is threaded laterally through sufficient additional vertical house wall studs to provide a release mechanism located at least three feet away from the side of the window on which cylinder 45 is mounted including angle iron 41 and post 39.

Thus it is seen that plate 36 is heavily bolted into the existing lateral wall structural beams and studs, as opposed to merely the window frame construction exemplified by the jamb 26. Likewise, the angle iron 41 is multiply attached through jamb 25 into the wall structurals 31 and 35. These screws, 37 and 42, mounting members 36 and 41, are covered and protected by posts 18 and 39, respectively, when the guard frame 18, 39, 20 is mounted on plate 36 by posts 38 and angle iron 41 by plunger 47. Since neither the posts 38 nor plunger 37 penetrate the inboard walls of post 18 and 39, these connections, also, are protected from access by a would be intruder. The fact that the bars or beams 20 are round and frictionally fit within the inboard openings 18*b* and 39*a* in posts 18 and 39, whereby to be rotatable therewithin, makes them relatively immune to hacksaw attack.

In operation of the device, the plate 36 is installed in one sash run 21 of the outer upper window sash 14. This installation is as seen in FIG. 1, preferably at a level which will enable the upper window sash to be lowered at least six inches. If the mounting is much lower than that, then too much access is available with respect to the lower inner sash. Screws 37 are inserted through prepared holes drilled through the base of sash run 21 as well as passages or openings 26*a* drilled through jamb 26. Screws 37 are then threadably engaged with center leg 32 and somewhat, at least (preferably at least a half inch) into the adjacent two-by-four stud on that side of the window.

Angle iron 41 is mounted in sash run 21 opposite plate 36 and at the same height. Before the angle iron 41 is screwed to the structural outboard of the window frame construction, the sash run 21 is centrally drilled with an enlarged opening 53, which enlarged opening is also drilled through jamb 25, center leg 31 and preferably through stud 35 next thereto. Holes are also drilled through jamb 25 at 25*a* for screws 42, such holes also penetrating the base of sash run 21 centrally thereof. With said large and small openings made as described, angle iron 41 (with cylinder 45 welded or otherwise fixedly attached to face 40 thereof) may be attached within sash run 21 by screws 42. Suitable access must be provided into the wall interior of the building to drill cable 49 receiving passageways through, preferably, at least the next two adjacent studs so that cable 49 may pass therethrough. A cable end grab member or handle (not seen) is provided through the inner wall of the house at least three feet from the side of the window having angle iron 41 thereat.

Thus the plate 36 and angle iron 41, as well as cylinder 45 and its working mechanism have been installed. At this point, the frame involving posts 18 and 39 and the plurality herefour) of bars 20 interconnected therebetween is ready to be mounted or attached. Bars 20 are fitted into the opposed openings 18*b*, 39*a* on the inboard faces of posts 18 and 39. Then, typically (see FIG. 3), the outboard face of post 18 (FIG. 4 and FIG. 3) is fitted, via openings 18*a* therewithin, over posts, studs or extensions 38 on plate 36. With the guard frame 18, 39, 20 supported, then, by one individual or person with the post 18-member 38 engagement in the position of the dotted lines in FIG. 3, a second person then may pull on the cable release to cause member 47 to retract into opening 44. The post 39 then may be swung into place and shifted or moved as required to obtain the proper engagement of rod 47 in opening 39*b*. At this point, then, the protective guard system is in effect and very effectively invulnerable from the outside except under the most extraordinary conditions.

On the other hand, to remove the guard frame 18, 39 and 20 from engagement with plate 36 and angle iron 41 in case of fire, other emergency or the like, only one person is needed. That is, upon pull back of plunger 47 from indoors, the post 39 will slump sufficiently that opening 39*b* will drop below registry with opening 44, thus in effect freeing the one side of the guard frame. The frame may then be grasped adjacent post 39 and pulled out of angle iron 41 and thus out of engagement with members 38. This gives one person freedom to release the guard in case one wishes to exit or get out of the window from the inside of the building in a hurry.

Referring to FIG. 8, therein is shown a fragmentary elevation through the wall of the building in which the window frame is mounted. This is a view taken to the left of FIGS. 4 and 5, particularly FIG. 5. This view is in a different scale (smaller) than that seen in FIGS. 4 and 5.

In FIGS. 4 and 5, as has been described, a passageway 51, 52 is provided through the paired two-by-fours 31 and 35 to the left of the cylinder 45. Cable 49, which is attached to release member 47, is taken to the left in the views of FIGS. 4 and 5 laterally of the window frame construction and preferably at least three feet or more from the left hand portion of the window seen in the views, such as at 13 and 17 in FIG. 1. Typically, the wall studs are 14½ inches apart in a conventional wall. What FIG. 8 shows is cable 49 extending through a wall stud 55 having an opening 56 therethrough and passing to and through one side of a recessed plastic or metal (such as aluminum) box or receptacle 57 in the wall. Handle 58 is attached to cable 49 within box 57. Another wall stud 59 is seen to the left in FIG. 8.

Looking at FIGS. 4 and 5, cable 49 passes through passages 51 and 52 in paired studs 31 and 35 to the left in those views. This is also seen in the left hand portion of FIG. 7. Since the studs are typically 14½ inches apart, cable 49 will pass through an additional stud (not seen) between stud 55 and stud 35 in the wall. Cable 49 then passes through opening 56 and thence to cup or receptacle 57. This spacing away of the release handle for the bar frame 18, 39 and 20 makes it certain that a would be intruder cannot reach through bars 20 and around to the left in FIGS. 4 and 7 to grasp handle 58 and release the bar assembly 18, 39 and 20 by pulling on cable 49 and retracting member 47 from within opening 39*b* in post 39.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter set forth or shown in the accompanying drawings is to be interpreted as illustrative and not in a limiting sense.

I claim:

1. A guard unit for a window frame construction having a top jamb header, a bottom sill, vertical side jambs, sash runs mounted inwardly with respect to said jambs, an upper sash mounted outwardly of said frame and a lower sash mounted inwardly of said frame, said window itself framed and supported by wall structurals, comprising, in combination:

(1) an elongate, vertical plate secured in one of the sash runs for the upper sash and in the lower part of said run, said plate extending inwardly in a direction perpendicular to the sashes, (2) an angle iron secured in the other one of said sash runs, with one outward leg of the angle extending at right angles to said plate and the other inward leg of the angle extending parallel to and in opposition to said plate, said inward leg being secured in the opposite sash run thereto, (3) a frame including a plurality of central, vertically spaced apart, normally horizontal bars and a pair of outer, normally vertical posts receiving the ends of the bars therewithin, (4) fixed means cooperating between the plate and one first vertical post of the frame for removably engaging said plate and post together and (5) moveable means cooperating between the inward leg of the angle iron and the other, second vertical post of the frame for removably engaging said angle iron inward leg and the other, second vertical post together.

2. A device as in claim 1 wherein the frame posts are of substantially rectangular transverse section with substantially parallel inner and outer sides and the means cooperating between the plate and the first vertical post of the frame comprises a plurality of inwardly extending rigid members fixed to said plate engageable with openings in the outer side of said first post.

3. A device as in claim 1 wherein the frame posts are of substantially rectangular transverse section with substantially parallel inner and outer sides and the means cooperating between the inward leg of the angle and the second vertical post of the frame comprises an axially moveable plunger rod extendable through said angle inward leg and removably engageable with an opening in the other side of the said second post.

4. A device as in claim 1 wherein the means cooperating between the plate and the first vertical post of the frame comprises a plurality of inwardly extending rigid members on said plate engageable with openings in said first post and the means cooperating between the angle inward leg and the second vertical post of the frame comprises an axially moveable rod removably engageable with an opening in said second post.

5. A device as in claim 1 wherein the lengths of the plate and the angle iron are substantially equal to one another and also substantially equal to the lengths of the posts on the frame.

6. A device as in claim 1 wherein the plate and angle iron and first and second vertical posts are positioned a substantial distance below the lower end of the closed upper sash so that the latter may be opened for ventilation.

7. A device as in claim 1 wherein the plate and angle iron are secured to wall structurals as well as window frame structurals.

8. A device as in claim 1 wherein the means cooperating between the angle irons and the second post comprises a spring loaded plunger whose actuator is led through wall structurals.

9. A guard unit for a window frame construction having a top jamb header, a bottom sill, vertical side jambs, sash runs mounted inwardly with respect to said jambs, an upper sash mounted outwardly of said frame and a lower sash mounted inwardly of said frame, said window itself framed and supported by wall structurals comprising, in combination:

(1) an elongate, vertical plate secured in one of the sash runs for the upper sash in the lower part of said run, said plate extending perpendicular to the direction of extension of the sashes, (2) an angle iron secured in the other one of the sash runs, with one outward leg of the angle extending at right angles to said plate and the other inward leg of the angle extending parallel to and in opposition to said plate, being secured in the opposite sash run thereto, (3) a frame including a plurality of central, vertically spaced apart, normally horizontal bars and a pair of outer normally vertical posts receiving the ends of the bars therewithin, (4) means cooperating between the plate and one first vertical post of the frame for removably engaging said plate and post together and (5) means cooperating between the inward leg of the angle iron and the other, second vertical post of the frame for removably engaging said angle iron inward leg and the other, second vertical post together, (6) the frame posts being of substantially rectangular transverse section with substantially parallel inner and outer sides, the means cooperating between the plate and the first vertical post of the frame comprising a plurality of inwardly extending rigid members fixed to said plate and engageable with openings in the outer side of said first post, (7) the means cooperating between the inward leg of the angle iron and the second vertical post of the frame comprising an axially moveable plunger rod extendable through said angle iron inward leg and removably engageable with an opening in the outer side of the second post.

10. A device as in claim 9 wherein the length of the first plate and the angle iron are substantially equal to one another and also substantially equal to the length of the posts on the frame.

11. A device as in claim 1 wherein the plate and angle iron and first and second vertical posts are positioned a substantial distance below the lower end of the closed upper sash so that the latter may be opened for ventilation.

12. A device as in claim 1 wherein the plate and angle iron are secured to wall structurals as well as window frame structurals and the means cooperating between the angle iron and the second post comprises a spring loaded plunger whose actuator is led through wall structurals.

* * * * *